US010847894B2

(12) United States Patent
Doskocil

(10) Patent No.: US 10,847,894 B2
(45) Date of Patent: Nov. 24, 2020

(54) BIDIRECTIONAL ANTENNA ASSEMBLY

(71) Applicant: MP Antenna, Ltd., Elyria, OH (US)

(72) Inventor: Adam Doskocil, Hinckley, OH (US)

(73) Assignee: MP ANTENNA LTD., Elyria, OH (US)

( * ) Notice: Subject to any disclaimer, the term of this patent is extended or adjusted under 35 U.S.C. 154(b) by 136 days.

(21) Appl. No.: 16/127,409

(22) Filed: Sep. 11, 2018

(65) Prior Publication Data

US 2019/0081406 A1 Mar. 14, 2019

Related U.S. Application Data

(60) Provisional application No. 62/556,635, filed on Sep. 11, 2017.

(51) Int. Cl.

| | |
|---|---|
| ***H01Q 15/18*** | (2006.01) |
| ***H01Q 1/32*** | (2006.01) |
| ***H01Q 15/24*** | (2006.01) |
| ***H01Q 21/26*** | (2006.01) |
| ***H01Q 21/24*** | (2006.01) |
| ***H01Q 1/22*** | (2006.01) |

(52) U.S. Cl.

CPC ..... *H01Q 15/18* (2013.01); *H01Q 1/2283* (2013.01); *H01Q 1/3208* (2013.01); *H01Q 1/3275* (2013.01); *H01Q 1/3291* (2013.01); *H01Q 15/24* (2013.01); *H01Q 21/24* (2013.01); *H01Q 21/26* (2013.01)

(58) Field of Classification Search

CPC ..... H01Q 15/18; H01Q 1/2283; H01Q 15/24; H01Q 21/24; H01Q 21/26; H01Q 1/3208; H01Q 1/3291

USPC ..... 343/912

See application file for complete search history.

(56) References Cited

U.S. PATENT DOCUMENTS

| | | | | |
|---|---|---|---|---|
| 6,037,912 | A * | 3/2000 | Demarre | H01Q 9/16 343/795 |
| 6,943,735 | B1 * | 9/2005 | Cadotte, Jr. | H01O 1/38 343/700 MS |
| 2017/0085003 | A1 * | 3/2017 | Johnson | H01Q 13/24 |
| 2020/0091990 | A1 * | 3/2020 | Ho | H01Q 1/246 |

* cited by examiner

*Primary Examiner* — Huedung X Mancuso

(74) *Attorney, Agent, or Firm* — Tarolli, Sundheim, Covell & Tummino LLP

(57) ABSTRACT

A bidirectional antenna assembly includes a radiative assembly operatively connected to an antenna feed and at least one passive conductive element. The passive conductive element includes at least first and second planar conductive sheets, each which are substantially perpendicular to a plane passing through the connection of the radiative assembly to the antenna field and arranged at an angle greater than ninety degrees relative to one another. The passive conductive element interacts with the radiative assembly to provide a bidirectional radiation pattern.

17 Claims, 6 Drawing Sheets

BIDIRECTIONAL ANTENNA ASSEMBLY

RELATED APPLICATIONS

This application claims priority from U.S. Patent Application Ser. No. 62/556,635, filed 11 Sep. 2017, which is incorporated herein in its entirety.

TECHNICAL FIELD

This invention relates to radio communications, and more particularly, to a bidirectional antenna assembly.

BACKGROUND

A directional antenna is a radio-frequency (RF) wireless antenna designed to function more effectively in some directions than in others. The purpose of that directionality is improving transmission and reception of communications and reducing interference. For most terrestrial wireless communications purposes, antenna directionality matters only in the azimuth, or horizontal, plane. For satellite and space-communications applications, both the azimuth and elevation (angle above the horizon) are important. A straight, vertically-oriented antenna such as a dipole measuring ½ wavelength from end-to-end is omnidirectional in the azimuth plane, meaning that it radiates and receives equally well in all horizontal directions. In any elevation plane, however, a vertical dipole exhibits the most gain parallel to the earth's surface and the least gain directly upward. A horizontally oriented dipole antenna produces more gain off the sides than off the ends in the azimuth plane, so it is bidirectional for terrestrial communications purposes. Horizontal dipole antennas find favor primarily among amateur radio operators. Directional antennas usually exhibit unidirectional properties. In other words, their maximum gain, or increase in efficiency occurs in a single direction. Bidirectional antennas have two high-gain directions, usually oriented opposite to each other in space.

SUMMARY OF THE INVENTION

In accordance with an aspect of the present invention, a bidirectional antenna assembly includes a radiative assembly operatively connected to an antenna feed and at least one passive conductive element. The passive conductive element includes at least first and second planar conductive sheets, each which are substantially perpendicular to a plane passing through the connection of the radiative assembly to the antenna field and arranged at an angle greater than ninety degrees relative to one another. The passive conductive element interacts with the radiative assembly to provide a bidirectional radiation pattern.

In accordance with another aspect of the present invention, a bidirectional antenna assembly includes a cylindrical enclosure with open first and second bases and formed from a conductive material. A radiative assembly has a characteristic wavelength and is located within a volume defined by the cylindrical enclosure. First and second planar conductive sheets are each connected to the cylindrical enclosure and extend at an oblique angle relative to a surface of the cylindrical enclosure.

In accordance with yet another aspect of the present invention, a bidirectional antenna assembly includes a ground plane and a first corner reflector formed from two planar structures formed from a conductive material meeting at a common edge and physically connected to the ground plane at a first location of a first side of the ground plane. A second corner reflector is formed from two planar structures formed from a conductive material meeting at a common edge and physically connected to the ground plane at a second location on the first side of the ground plane. A radiative assembly has a characteristic wavelength and extends above the ground plane at a third location. The first location, the second location, and the third location are selected such that a line defined by the common edge of the first corner reflector and the common edge of the second corner reflector in a plane substantially parallel to the ground plane passes through the radiative element.

DETAILED DESCRIPTION

Systems and methods for providing a bidirectional antenna assembly include a radiative assembly operatively connected to an antenna feed and at least one passive conductive element comprising at least first and second planar conductive sheets. The first and second planar conductive sheets are substantially perpendicular to a plane passing through the connection of the radiative assembly to the antenna field and arranged at an angle greater than ninety degrees relative to one another. The at least one passive conductive element interacts with the radiative assembly to provide a bidirectional radiation pattern. As a result, a single substantially omnidirectional radiative element can be used to provide a bidirectional radiation pattern. This can be exploited, for example, by mounting the bidirectional antenna assembly between two passenger compartments of a vehicle with multiple passenger compartments as to provide a first region of signal coverage within a first passenger compartment and a second region of signal coverage within a second passenger compartment.

Figure 1:
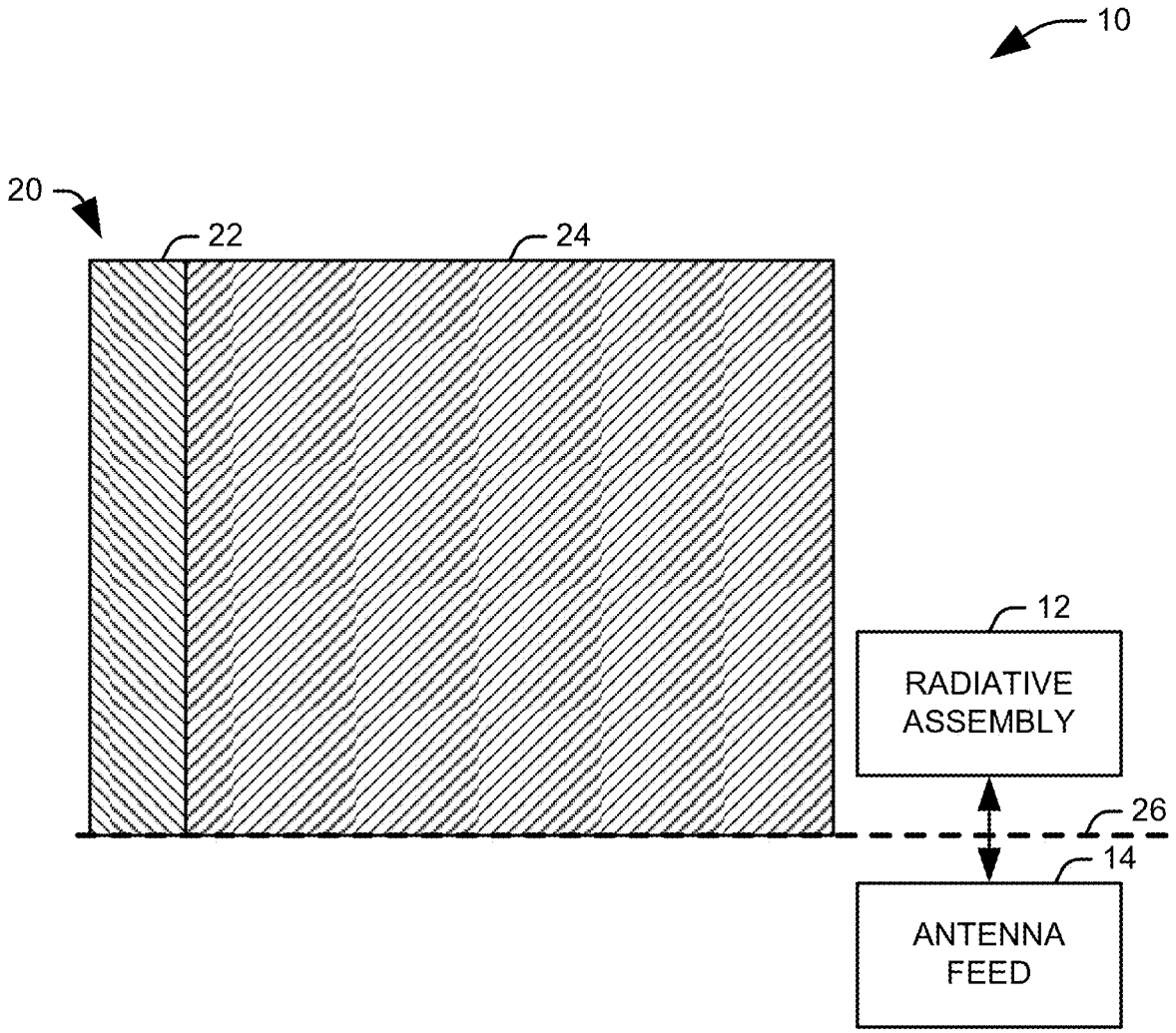
FIG. 1 illustrates a bidirectional antenna assembly in accordance with an aspect of the present invention.

FIG. 1 illustrates a bidirectional antenna assembly 10 in accordance with an aspect of the present invention. The assembly 10 includes a radiative assembly 12 operatively connected to an antenna feed (not shown). For the purposes of illustration, the connection to the antenna feed is It will be appreciated that the radiative assembly 12 can be selected to be substantially omnidirectional, as the bidirectionality of the assembly is provided via a passive conductive element 20. Instead, the radiative assembly 12 can be selected to provide a desired primary polarization (e.g., vertical or horizontal) for the bidirectional antenna assembly 10. In one implementation, the radiative assembly 12 comprises multiple elements meeting at a common apex.

At least one passive conductive element 20 includes at least first and second planar conductive sheets 22 and 24. Each of the first and second planar conductive sheets 22 and 24 are substantially perpendicular to a plane 26 passing through the connection of the radiative assembly to the antenna field and arranged at an angle of at least ninety degrees relative to one another. In the illustrated implementation, the two conductive sheets 22 and 24 are deployed at a ninety degree angle, with the first sheet 22 extending into the plane of the page, but it will be appreciated that some applications will utilize an angle greater than ninety degrees between the two sheets. The passive conductive element 20 interacts with the radiative assembly 12 to provide a bidirectional radiation pattern for the assembly 10.

In one implementation, the at least one passive conductive assembly includes a cylindrical enclosure, having open first and second bases and formed from a conductive material. The first and second planar conductive sheets are each connected to the open cylindrical enclosure and extend at an oblique angle relative to a surface of the open cylindrical enclosure. The surface of the open cylindrical enclosure can further have third and fourth planar conductive sheets that are each connected to the open cylindrical enclosure and extend at an oblique angle relative to another surface of the open cylindrical enclosure. The radiative assembly can be mounted on the second surface of the open cylindrical enclosure.

In another implementation, the antenna assembly 10 further includes a ground plane, and the at least one passive conductive element 20 includes a first corner reflector comprising two planar structures formed from a conductive material meeting at a common edge and physically connected to the ground plane at a first location of a first side of the ground plane and a second corner reflector comprising two planar structures formed from a conductive material meeting at a common edge and physically connected to the ground plane at a second location on the first side of the ground plane. In this implementation, the radiative assembly 12 can extend above the ground plane at a third location, and the first location, the second location, and the third location can be selected such that a line defined by the common edge of the first corner reflector and the common edge of the second corner reflector in a plane substantially parallel to the ground plane passes through the radiative assembly 12.

Figure 2:
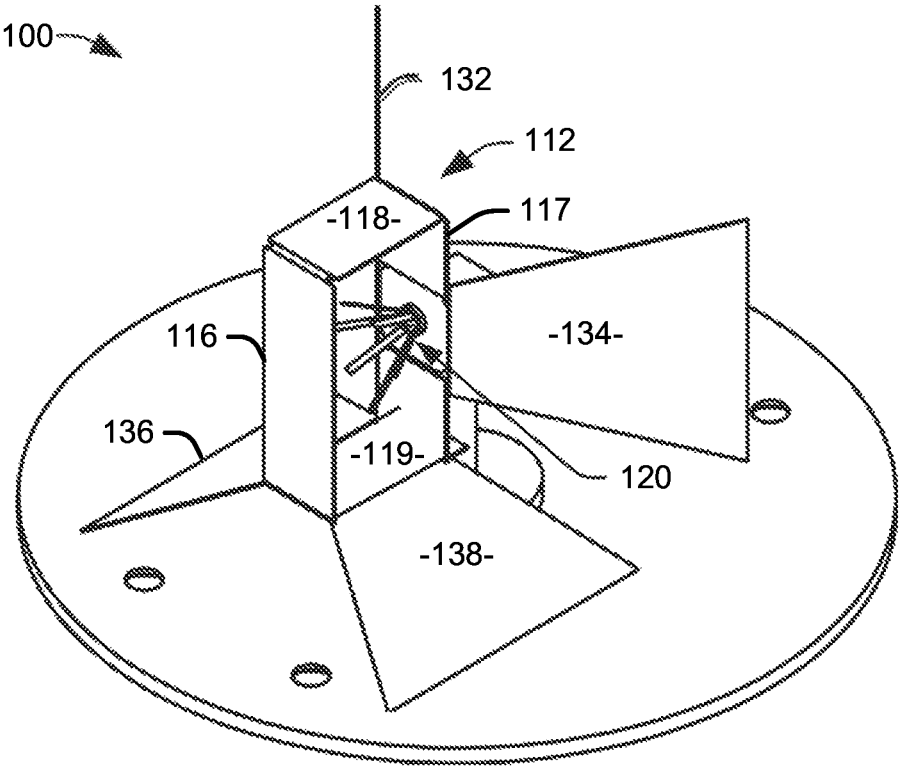
FIG. 2 illustrates a perspective view of one implementation of a bidirectional antenna in accordance with an aspect of the present invention.
Figure 3:
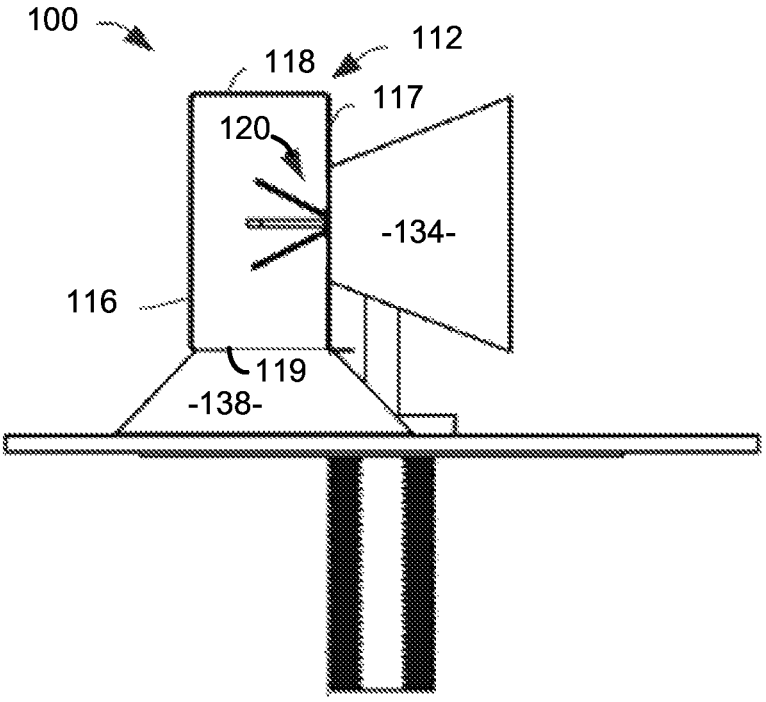
FIG. 3 illustrates a side view of the bidirectional antenna of FIG. 2.
Figure 4:
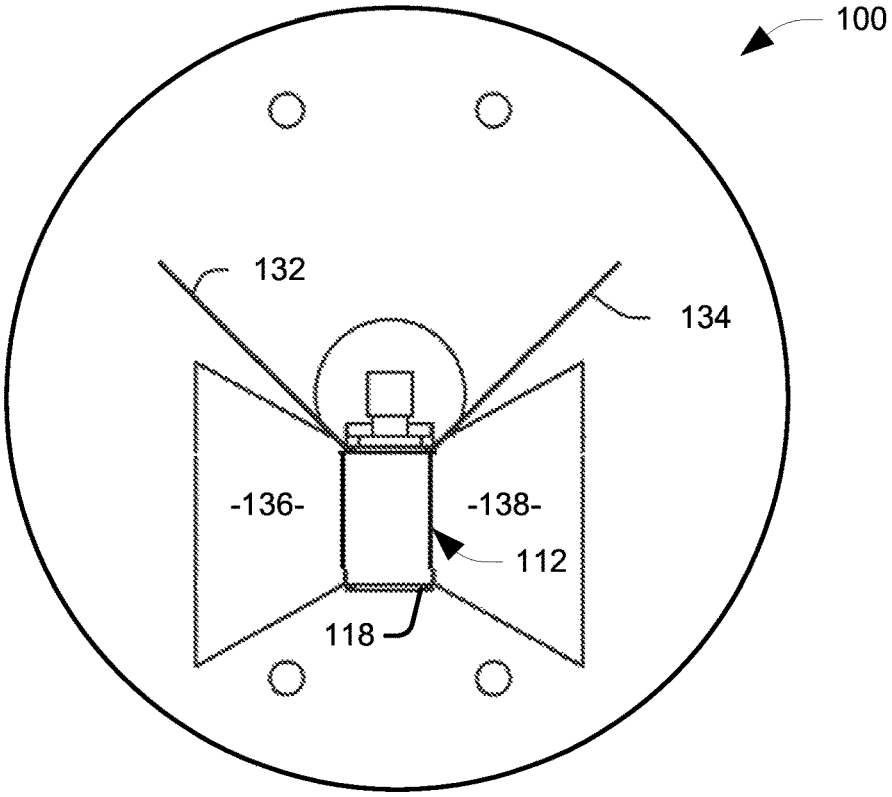
FIG. 4 illustrates a top view of the bidirectional antenna of FIG. 2.

FIG. 2 illustrates a perspective view of one implementation of a bidirectional antenna 100 in accordance with an aspect of the present invention. FIG. 3 illustrates a side view of the bidirectional antenna of FIG. 2, while FIG. 4 illustrates a top view of the bidirectional antenna of FIG. 2. It will be appreciated that terms such as "side" or "top" are used here in a relative sense to indicate an orthogonal relationship between the perspectives of FIGS. 3 and 4, and that the bidirectional antenna can be deployed at an arbitrary orientation based upon a desired direction of the bidirectional radiation pattern. The bidirectional antenna of FIGS. 2-4 can be configured to provide a radiation pattern that is substantially horizontally polarized, with a radiative assembly 120 selected to provide, in combination with the remaining elements of the bidirectional antenna 100, the desired polarization.

The antenna 100 includes an open cylindrical enclosure 112 formed from a conductive material. In the illustrated implementation, the open cylindrical enclosure 112 is an open rectangular cylinder, but it will be appreciated that elliptical, circular, or other shapes could be employed within the spirit of the invention. When a rectangular cylinder is used, one pair of sides or surfaces of the rectangle can have a length between one-half and three-quarters of the characteristic wavelength and a second pair of sides or surfaces can have a length between one-quarter and three-eighths of the characteristic wavelength. A width of the assembly, that is, the distance between the open bases of the cylinder, can be between one-fifth and one-third of the characteristic wavelength. In the illustrated implementation, the antenna 100 is intended for use in a frequency band around 5 GHz, with a characteristic wavelength of around 2.3 inches, and the open cylindrical enclosure 112 has a width between the open sides of about 0.5 inches, a first pair of surfaces 116 and 117 having lengths of approximately 1.5 inches, and a second pair of surfaces 118 and 119 having lengths of approximately 0.76 inches.

A radiative assembly 120 is located within a volume defined by the open cylindrical enclosure 112. In the illustrated implementation, the radiative assembly 120 includes a plurality of linear elements of differing lengths joined at a common apex at respective first ends. Each linear element in the radiative assembly 120 extends at an oblique angle relative to a closest wall of the cylindrical enclosure. In the illustrated implementation, the oblique angle is between sixty and sixty-five degrees for each of the linear elements. The illustrated bidirectional antenna 100 is configured to operate in a frequency band around 5 gigahertz. Accordingly, the lengths of the linear elements can lie in a range including a quarter of a wavelength associated this frequency, specifically around 0.59 inches, such that the element lengths range from 0.4 to 0.99 inches. It will be appreciated that these lengths are merely provided for the purpose of example, and other lengths within a range around one quarter of the characteristic wavelength could be used. Further, it will be appreciated that the range itself, and its associated lengths, will vary essentially linearly with the characteristic wavelength of the system.

A first pair of planar conductive sheets 132 and 134 are connected to the open cylindrical enclosure 112 and extend at an oblique angle relative to the open cylindrical enclosure. The first pair of planar conductive sheets 132 and 134 are attached to a surface 117 of the first pair of surfaces of the open cylindrical enclosure 112, and extend away from the radiative element 120. In the illustrated implementation, the first pair of planar conductive sheets 132 and 134 are shaped as isosceles trapezoids, with a shorter parallel edge of the trapezoid attached to the surface 116 extending to a longer parallel edge of the trapezoid having a length between one-half and three-quarters of the characteristic wavelength of the radiative element 120. The longer parallel edge has a length of around 1.5 inches. The planar conductive sheets 132 and 134 each form an angle of between 91 and 140 degrees with the surface 117, and in one embodiment, an angle of 135 degrees.

A second pair of planar conductive elements 136 and 138 are attached to a surface 119 of the second pair of surfaces of the open cylindrical enclosure 100, and extend away from the radiative element 120. In the illustrated implementation, the second pair of planar conductive sheets 136 and 138 are shaped as isosceles trapezoids, with a shorter parallel edge of the trapezoid attached to the surface 119 extending to a longer parallel edge of the trapezoid. Each of the open cylindrical enclosure 112 and the first and second pairs of conductive sheets 132, 134, 136, and 138 are configured such that a radiation pattern of the radiative element 120 is substantially confined to lobes aligned with the open ends of the open cylindrical enclosure 112. In one example, each of the second pair of planar conductive sheets forms an angle of between 120 and 155 degrees with the surface 119, with the longer edge of the trapezoid having a length of approximately 1.76 inches. In one implementation, the second pair of planar conductive sheets each form an angle of 150 degrees with the surface 119. Accordingly, the antenna assembly 100 can provide substantial gain in these two directions.

Figure 5:
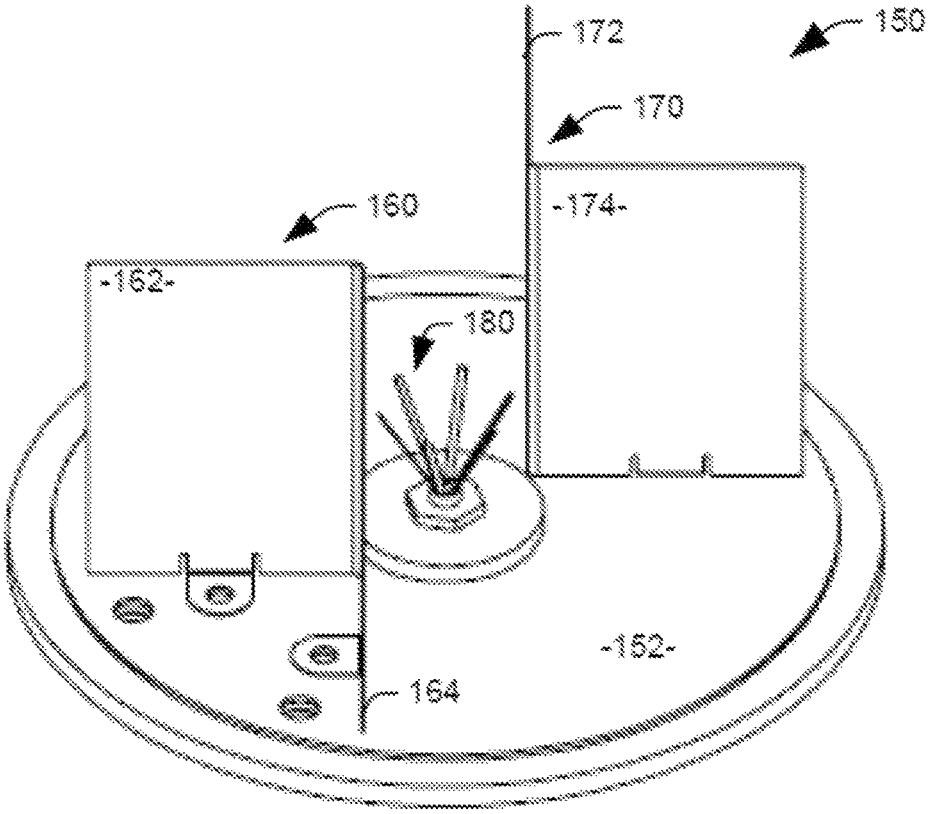
FIG. 5 illustrates a perspective view of another implementation of a bidirectional antenna in accordance with an aspect of the present invention.
Figure 6:
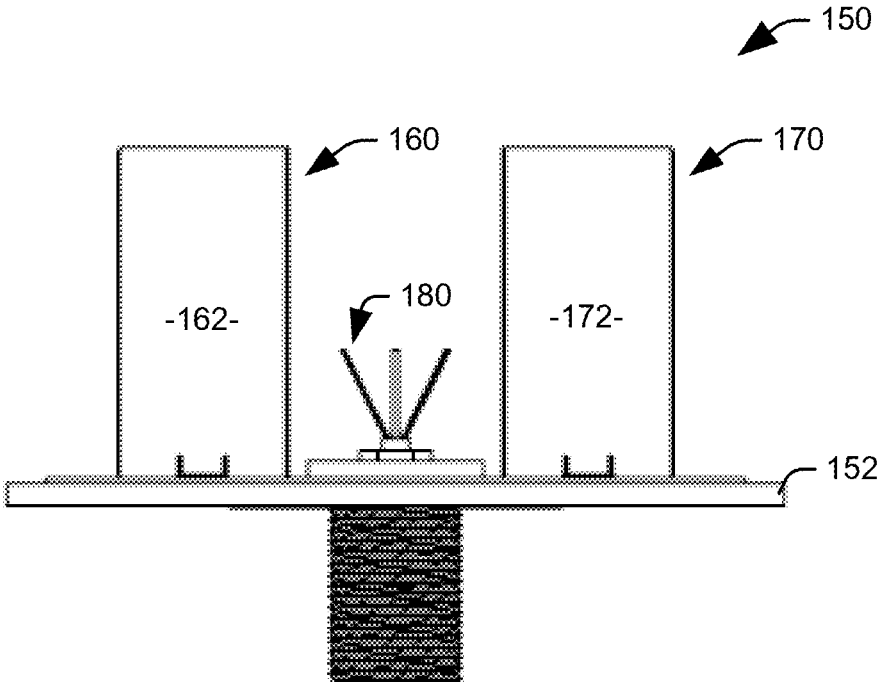
FIG. 6 illustrates a side view of the bidirectional antenna of FIG. 5.
Figure 7:
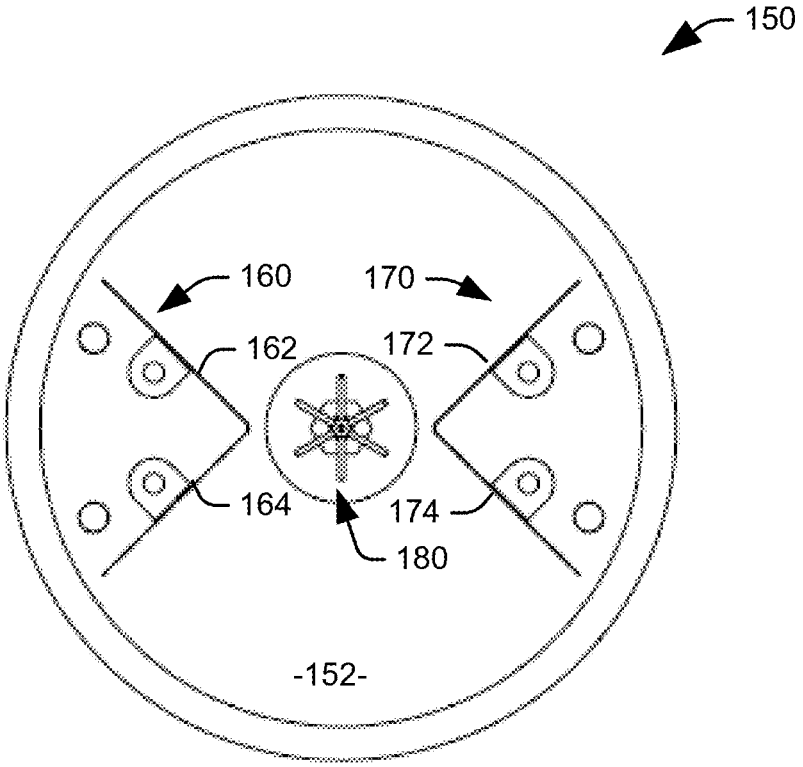
FIG. 7 illustrates a top view of the bidirectional antenna of FIG. 5.

FIG. 5 illustrates a perspective view of another implementation of a bidirectional antenna 150 in accordance with an aspect of the present invention. FIG. 6 illustrates a side view of the bidirectional antenna of FIG. 5, while FIG. 7 illustrates a top view of the bidirectional antenna of FIG. 5. Again, it will be appreciated that terms such as "side" or "top" are used here in a relative sense to indicate an orthogonal relationship between the perspectives of FIGS. 6 and 7, and that the bidirectional antenna of FIG. 5 can be deployed at an arbitrary orientation based upon a desired direction of the bidirectional radiation pattern. The bidirectional antenna of FIGS. 5-7 can be configured to provide a radiation pattern that is substantially vertically polarized, with a radiative assembly 180 selected to provide, in combination with the remaining elements of the bidirectional antenna 150, the desired polarization.

The bidirectional antenna 150 includes a ground plane 152 and first and second corner reflectors 160 and 170 each physically connected to the ground plane on a first side of the ground plane. The first corner reflector 160 includes two planar structures 162 and 164 each formed from a conductive material meeting at a common edge. The second corner reflector 170 also includes two planar structures 172 and 174 meeting at a common edge. In the illustrated implementation, the pairs of planar structures comprising the first and second corner reflectors 160 and 170 each meet at a ninety-degree angle, although it will be appreciated that a range from thirty to one hundred eighty degrees can be used, depending on the application.

The antenna further includes a radiative assembly 180 extending above the ground plane. In the illustrated implementation, the radiative assembly 180 includes a plurality of linear elements of differing lengths joined at a common apex at respective first ends. Each linear element in the radiative assembly 180 extends at an oblique angle relative to the ground plane 152. In the illustrated implementation, the oblique angle is substantially equal to sixty degrees for each of the linear elements. The illustrated bidirectional antenna 150 is configured to operate in a frequency band around 5 gigahertz. Accordingly, the lengths of the linear elements can lie in a range including a quarter of a wavelength associated this frequency, specifically around 0.59 inches, such that the element lengths range from 0.4 to 0.99 inches. It will be appreciated that these lengths are merely provided for the purpose of example, and other lengths within a range around one quarter of the characteristic wavelength could be used. Further, it will be appreciated that the range itself, and its associated lengths, will vary essentially linearly with the characteristic wavelength of the system.

Each of the radiative assembly 180, the first corner reflector 160, and the second corner reflector 170 are positioned such that a line defined by the common edge of the first corner reflector and the common edge of the second corner reflector in a plane substantially parallel to the ground plane passes through the radiative element 180. Further, the first and second corner reflectors 160 and 170 are oriented such that the radiative assembly 180 is positioned outside of the volumes defined by the first and second corner reflectors and a common edge of each corner reflector represents their closest approach to the radiative assembly and to each other. Accordingly, the two planar structures defining each of the first corner reflector 160 and the second corner reflector 170 extend away from the third location. In this orientation, the radiation pattern of the radiative assembly 180 is constrained by the corner reflectors 160 and 170 to two lobes in opposing directions, particularly at the horizon. Accordingly, the antenna assembly 150 can provide substantial gain in these two directions.

Figure 8:
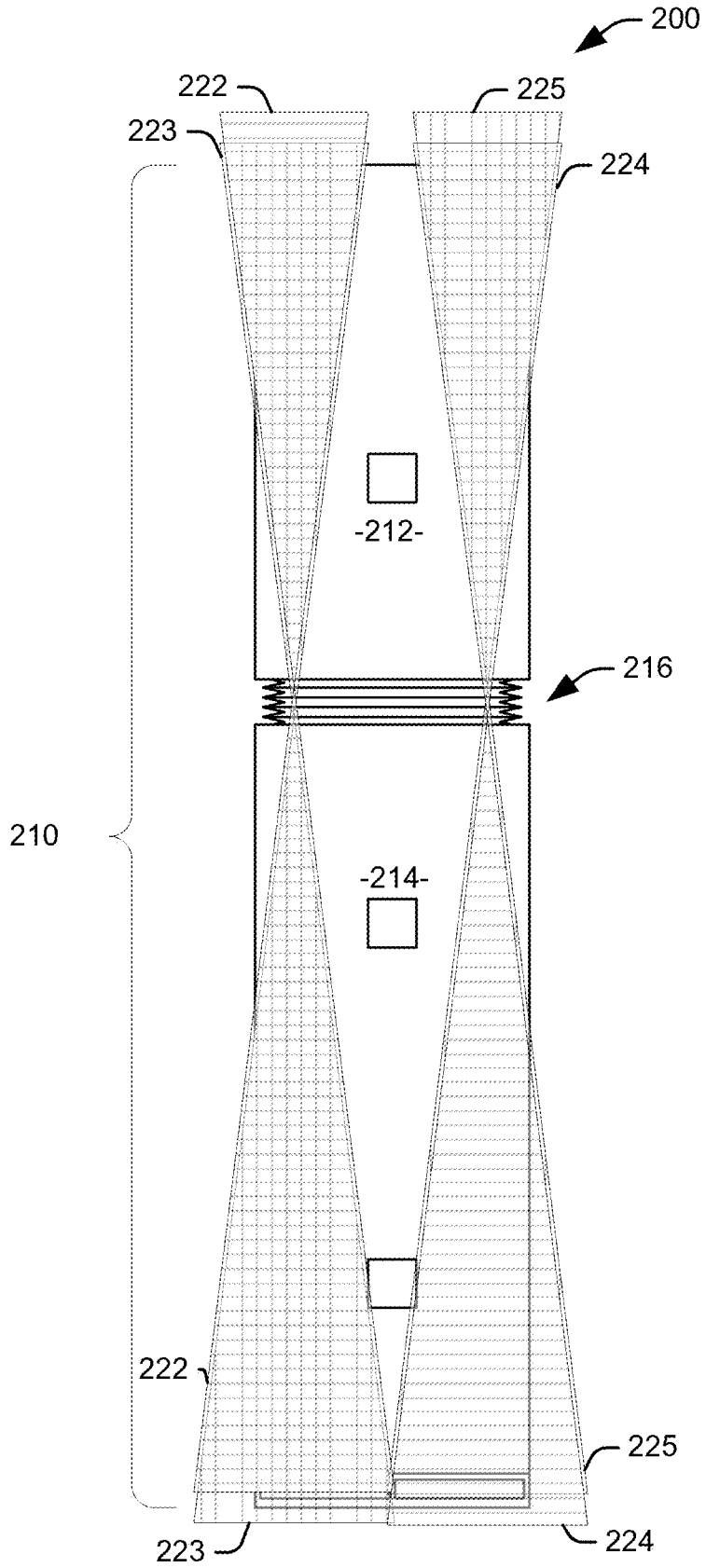
FIG. 8 illustrates a first example implementation of a bidirectional antenna in accordance with an aspect of the present invention on a vehicle.

FIG. 8 illustrates an example implementation 200 of a bidirectional antenna in accordance with an aspect of the present invention on a vehicle 210. In the illustrated implementation, the vehicle 210 is an articulated bus having first and second passenger compartments 212 and 214 connected via a flexible connector 216. It will be appreciated, however, that the illustrated implementation 210 is not specific to any particular vehicle, and could be implemented on any passenger or cargo vehicle, such as a train, plane, automobile, or boat, for which signal coverage, such as a Wi-Fi or RFID signal, is desired along the length of the vehicle. In the illustrated implementation, four bidirectional antennas (not shown) can be connected to respective signal sources and deployed near a center point of desired range of coverage in the vehicle 210. In the illustrated implementation, the antennas are deployed in or near the flexible connector 216, with a pair of antennas on each side of the vehicle. Each antenna provides an associated region of signal coverage 222-225 in both directions along the length of the vehicle.

In accordance with an aspect of the present invention, each pair of antennas can include one vertically polarized antenna and one horizontally polarized antenna. An example of a horizontally polarized antenna can be found in FIGS. 2-4 and an example of a vertically polarized antenna can be found in FIGS. 5-7. Accordingly, for a first side of the vehicle 210, a first region of signal coverage 222 is horizontally polarized and a second region of signal coverage 223 is vertically polarized. Similarly, for a second side of the vehicle 210, a third region of signal coverage 224 is horizontally polarized and a fourth region of signal coverage 225 is vertically polarized. It will be appreciated that, for passengers sitting on either side of the vehicle, as passenger vehicles are normally configured, signal coverage with significant polarization diversity should be available, allowing for a more reliable signal during transit.

Figure 9:
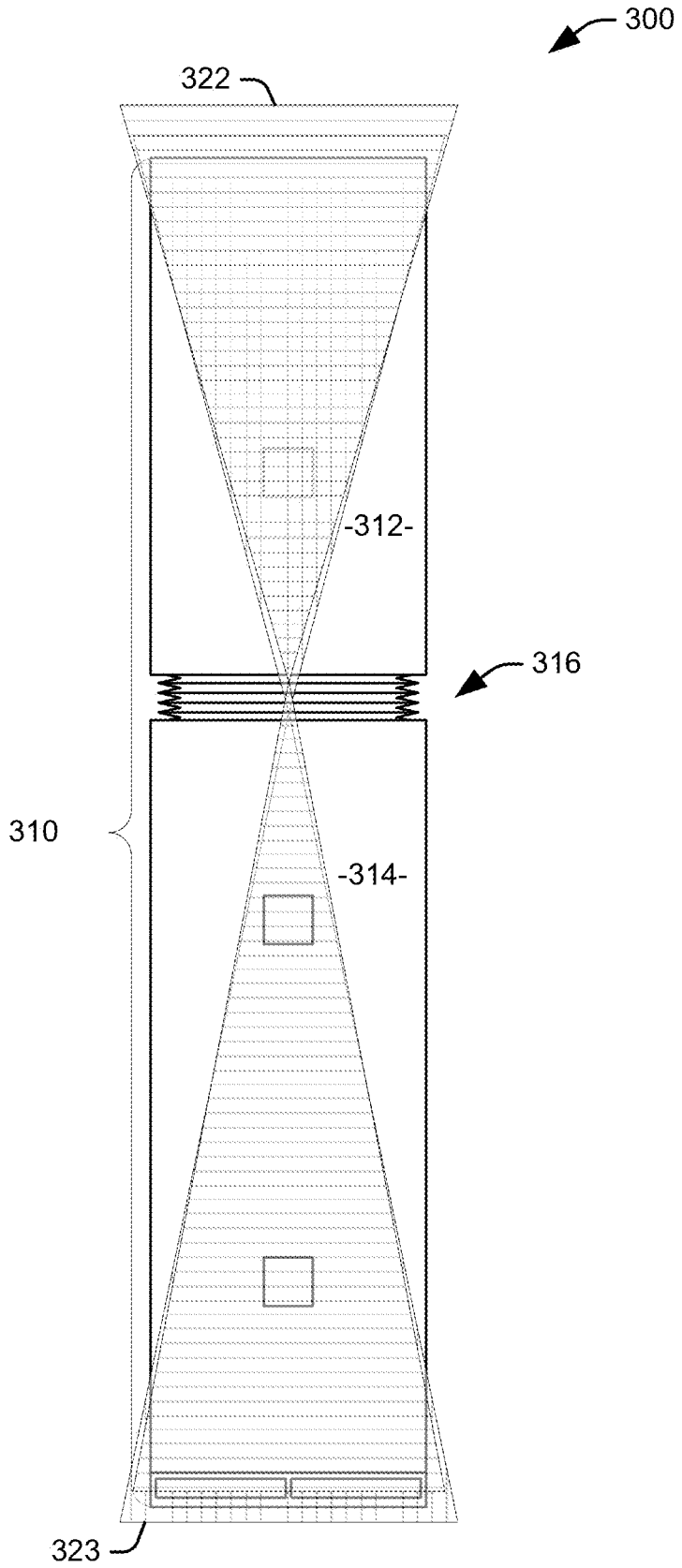
FIG. 9 illustrates a second example implementation of a bidirectional antenna in accordance with an aspect of the present invention on a vehicle.

FIG. 9 illustrates an example implementation of a bidirectional antenna in accordance with an aspect of the present invention on a vehicle 310. In the illustrated implementation, the vehicle 310 is an articulated bus having first and second passenger compartments 312 and 314 connected via a flexible connector 316. It will be appreciated, however, that the illustrated implementation 310 is not specific to any particular vehicle, and could be implemented on any passenger or cargo vehicle, such as a train, plane, automobile, or boat, for which signal coverage, such as a Wi-Fi or RFID signal, is desired along the length of the vehicle. In the illustrated implementation, two bidirectional antennas (not shown) can be connected to a multiple radios or a singular signal source and deployed near a center point of desired range of coverage in the vehicle 310. In the illustrated implementation, the antennas are deployed near the center of the vehicle. Each antenna provides an associated region of signal coverage 322-323 in both directions along the length of the vehicle.

In accordance with an aspect of the present invention, each pair of antennas can include one vertically polarized antenna and one horizontally polarized antenna. An example of a horizontally polarized antenna can be found in FIGS. 2-4 and an example of a vertically polarized antenna can be found in FIGS. 5-7. Accordingly, a first region of signal coverage 322 is horizontally polarized and a second region of signal coverage 323 is vertically polarized. It will be appreciated that communications between the vehicle and infrastructure connection points (not shown) will show increased throughput and signal coverage with significant polarization diversity, allowing for a more reliable vehicle to infrastructure communications during transit.

What have been described above are examples of the present invention. It is, of course, not possible to describe every conceivable combination of components or methodologies for purposes of describing the present invention, but one of ordinary skill in the art will recognize that many further combinations and permutations of the present invention are possible. Accordingly, the present invention is intended to embrace all such alterations, modifications, and variations that fall within the scope of the appended claims.

What is claimed is:

1. A bidirectional antenna assembly comprising:

a radiative assembly operatively connected to an antenna feed; and at least one passive conductive element comprising at least first and second planar conductive sheets, each of the first and second planar conductive sheets being substantially perpendicular to a plane passing through the connection of the radiative assembly to the antenna field and arranged at an angle of at least ninety degrees relative to one another, the at least one passive conductive element interacting with the radiative assembly to provide a bidirectional radiation pattern, the at least one passive conductive assembly comprising a cylindrical enclosure, having open first and second bases and formed from a conductive material, with the first and second planar conductive sheets each connected to the open cylindrical enclosure and extending at an oblique angle relative to a surface of the open cylindrical enclosure.

2. The bidirectional antenna assembly of claim 1, wherein the surface of the open cylindrical enclosure is a first surface and the bidirectional antenna assembly further comprises third and fourth planar conductive sheets, each connected to the open cylindrical enclosure and extending at an oblique angle relative to a second surface of the open cylindrical enclosure.

3. The bidirectional antenna assembly of claim 2, wherein the radiative assembly is mounted on the second surface of the open cylindrical enclosure.

4. The bidirectional antenna assembly of claim 1, wherein the bidirectional antenna assembly is mounted between two passenger compartments of a vehicle as to provide a first region of signal coverage within a first passenger compartment and a second region of signal coverage within a second passenger compartment.

5. The bidirectional antenna assembly of claim 1, wherein the radiative assembly comprises multiple elements meeting at a common apex.

6. The bidirectional antenna assembly of claim 5, wherein the bidirectional antenna assembly is mounted between two passenger compartments of a vehicle as to provide a first region of signal coverage within a first passenger compartment and a second region of signal coverage within a second passenger compartment.

7. A bidirectional antenna assembly comprising:

a cylindrical enclosure, having open first and second bases and formed from a conductive material;

a radiative assembly having a characteristic wavelength and located within a volume defined by the cylindrical enclosure;

first and second planar conductive sheets, each connected to the cylindrical enclosure and extending at an oblique angle relative to a first surface of the cylindrical enclosure; and third and fourth planar conductive sheets, each connected to the cylindrical enclosure and extending at an oblique angle relative to a second surface of the cylindrical enclosure.

8. The bidirectional antenna assembly of claim 7, wherein each of the third and fourth planar conductive sheets are shaped as isosceles trapezoids having a longest edge with a length between one-half and three-quarters of the characteristic wavelength.

9. The bidirectional antenna assembly of claim 7, wherein the cylindrical enclosure is rectangular and the first surface has a length between one-half and three-quarters of the characteristic wavelength.

10. The bidirectional antenna assembly of claim 9, wherein a second surface of the cylindrical enclosure, arranged perpendicularly to the first surface, has a length between one-quarter and three-eighths of the characteristic wavelength.

11. The bidirectional antenna assembly of claim 7, wherein each of the first and second planar conductive sheets form an angle of between ninety-one and one hundred forty degrees with the surface.

12. The bidirectional antenna assembly of claim 7, wherein a cylindrical enclosure has a width between the open first and second bases of between one-fifth and one-third of the characteristic wavelength.

13. A bidirectional antenna assembly comprising:

a ground plane;

a first corner reflector comprising two planar structures formed from a conductive material meeting at a common edge and physically connected to the ground plane at a first location of a first side of the ground plane;

a second corner reflector comprising two planar structures formed from a conductive material meeting at a common edge and physically connected to the ground plane at a second location on the first side of the ground plane; and a radiative assembly having a characteristic wavelength and extending above the ground plane at a third location, the first location, the second location, and the third location being selected such that a line defined by the common edge of the first corner reflector and the common edge of the second corner reflector in a plane substantially parallel to the ground plane passes through the radiative assembly;

wherein the third location is between the first location and the second location, and the first and second corner reflectors are oriented such that the two planar structures defining each of the first corner reflector and the second corner reflector extend away from the third location.

14. The bidirectional antenna assembly of claim 13, wherein the two planar structures comprising the first corner reflector form an angle substantially equal to ninety degrees and the two planar structures comprising the second corner reflector form an angle substantially equal to ninety degrees.

15. The bidirectional antenna assembly of claim 13, wherein the bidirectional antenna assembly is mounted between two passenger compartments of a vehicle as to provide a first region of signal coverage within a first passenger compartment and a second region of signal coverage within a second passenger compartment.

16. A bidirectional antenna assembly comprising:

a ground plane;

a radiative assembly operatively connected to an antenna feed; and at least one passive conductive element that interacts with the radiative assembly to provide a bidirectional radiation pattern, the at least one passive conductive element comprising:

a first corner reflector comprising first and second planar conductive sheets meeting at a common edge and physically connected to the ground plane at a first location of a first side of the ground plane, each of the first and second planar conductive sheets being substantially perpendicular to a plane passing through the connection of the radiative assembly to the antenna field and arranged at an angle of at least ninety degrees relative to one another; and a second corner reflector comprising third and fourth planar conductive sheets meeting at a common edge and physically connected to the ground plane at a second location of a first side of the ground plane.

17. The bidirectional antenna assembly of claim 16, wherein the radiative assembly extends above the ground plane at a third location, the first location, the second location, and the third location being selected such that a line defined by the common edge of the first corner reflector and the common edge of the second corner reflector in a plane substantially parallel to the ground plane passes through the radiative assembly.

* * * * *